US011753694B1

(12) United States Patent
Zhou et al.

(10) Patent No.: US 11,753,694 B1
(45) Date of Patent: Sep. 12, 2023

(54) PULSE CURRENT-ASSISTED LASER PEEN FORMING AND HYDROPHOBIC SURFACE PREPARING METHOD FOR ALUMINUM ALLOY

(71) Applicant: JIANGSU UNIVERSITY, Zhenjiang (CN)

(72) Inventors: Jianzhong Zhou, Zhenjiang (CN); Yanqiang Gou, Zhenjiang (CN); Li Li, Zhenjiang (CN); Yu Zhang, Zhenjiang (CN); Xiankai Meng, Zhenjiang (CN); Shu Huang, Zhenjiang (CN); Gaoqiang Jiang, Zhenjiang (CN); Pengfei Li, Zhenjiang (CN); Xv Feng, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 18/023,395

(22) PCT Filed: Jun. 6, 2022

(86) PCT No.: PCT/CN2022/097093

§ 371 (c)(1),
(2) Date: Feb. 27, 2023

(30) Foreign Application Priority Data

Apr. 26, 2022 (CN) ..... 202210445786.2

(51) Int. Cl.
*C21D 10/00* (2006.01)
*C22C 21/00* (2006.01)

(52) U.S. Cl.
CPC ..... *C21D 10/005* (2013.01); *C22C 21/00* (2013.01)

(58) Field of Classification Search
None
See application file for complete search history.

(56) References Cited

U.S. PATENT DOCUMENTS 6,197,133 B1 * 3/2001 Unternahrer ..... B23K 26/0622 372/18
2006/0054607 A1 * 3/2006 Wu ..... B23K 26/00 219/121.85
2013/0052479 A1 * 2/2013 Seetharaman ..... B23K 26/356 219/121.85

FOREIGN PATENT DOCUMENTS

CN 1695873 A 11/2005
CN 101007304 A 8/2007
(Continued)

OTHER PUBLICATIONS

Mostafa, Ayman M., et al. "Effect of Laser Shock Peening on the Hardness of AI-7075 Alloy." Journal of King Saud University—Science, vol. 31, No. 4, 2019, pp. 472-478 (Year: 2019).*
Zhang, Hao, et al. "Microstructure Evolution and Electroplasticity in TI64 Subjected to Electropulsing-Assisted Laser Shock Peening." Journal of Alloys and Compounds, vol. 802, 2019, pp. 573-582 (Year: 2019).*
(Continued)

*Primary Examiner* — Kevin E Yoon
*Assistant Examiner* — Ryan L Heckman
(74) *Attorney, Agent, or Firm* — Bayramoglu Law Offices LLC

(57) ABSTRACT

A pulse current-assisted laser peen forming and hydrophobic surface preparing method for an aluminum alloy includes the following steps: placing a pretreated aluminum alloy onto a shock platform, where electrodes are respectively provided at two ends of the aluminum alloy, and flowing silicone oil covers a surface of the aluminum alloy; determining a laser energy; applying a high-frequency pulse current to the surface of the aluminum alloy through the electrodes, where a shot peening laser generates a laser beam according to the laser energy to shock the surface of the aluminum alloy, and under an action of an electrical pulse and laser shock, the aluminum alloy shows a bent arc-shaped surface, with a shock surface forming a porous micro-nano multi-stage surface; and performing chemical modification on the shock surface of the aluminum alloy to reduce a
(Continued)

surface energy of the material, thereby obtaining a super-hydrophobic arc-shaped aluminum alloy surface.

6 Claims, 6 Drawing Sheets

(56) References Cited

FOREIGN PATENT DOCUMENTS

| | | | |
|---|---|---|---|
| CN | 102628095 | A | 8/2012 |
| CN | 103111751 | A | 5/2013 |
| CN | 103540715 | A | 1/2014 |
| CN | 110315210 | A | 10/2019 |
| CN | 110578047 | A | 12/2019 |
| CN | 112111780 | A | 12/2020 |
| CN | 112853086 | A | 5/2021 |
| CN | 113146049 | A | 7/2021 |
| JP | 2015105402 | A | 6/2015 |

OTHER PUBLICATIONS

He, Zhaoru, et al. "Laser Shock Peening Regulating Aluminum Alloy Surface Residual Stresses for Enhancing the Mechanical Properties: Roles of Shock Number and Energy." Surface and Coatings Technology, vol. 421, 2021, p. 127481. (Year: 2021).*

Wu, Jiajun, et al. "The New Technologies Developed from Laser Shock Processing." Materials, vol. 13, No. 6, 2020, p. 1453. (Year: 2020).*

Wu, Benxin, and Yung C. Shin. "A One-Dimensional Hydrodynamic Model for Pressures Induced near the Coating-Water Interface during Laser Shock Peening."Journal of Applied Physics, vol. 101, No. 2, 2007, p. 023510. (Year: 2007).*

Zhang, Chaoyi, et al. "Recent Developments and Novel Applications of Laser Shock Peening: A Review."Advanced Engineering Materials, vol. 23, No. 7, 2021, p. 2001216. (Year: 2021).*

Changchi Wang, Experiment and simulation analysis on laser peening convex forming of 2024-T351 aluminium alloy Sheet, 2018, pp. 1-62.

* cited by examiner

PULSE CURRENT-ASSISTED LASER PEEN FORMING AND HYDROPHOBIC SURFACE PREPARING METHOD FOR ALUMINUM ALLOY

CROSS REFERENCE TO THE RELATED APPLICATIONS

This application is the national phase entry of International Application No. PCT/CN2022/097093, filed on Jun. 6, 2022, which is based upon and claims priority to Chinese Patent Application No. 202210445786.2, filed on Apr. 26, 2022, the entire contents of which are incorporated herein by reference.

TECHNICAL FIELD

The present disclosure relates to the field of preparation of arc-shaped aluminum alloy functional surfaces, and in particular to a pulse current-assisted laser peen forming and hydrophobic surface preparing method for an aluminum alloy.

BACKGROUND

Aeronautical aluminum alloys have been widely applied to the aerospace field, as they can ensure structural strengths and minimize weights of parts. Due to a complicated service environment of an aircraft, the aeronautical aluminum alloy is prone to violent vibrations under external exciting loads. This causes fatigue failure of the aeronautical aluminum alloy, and greatly affects service life and safety of an aeronautical part. In the environment with a high altitude, a low temperature, and a high humidity, the surface of the aircraft is susceptible to icing. While an ice layer becomes thicker, flight operation is implemented hardly to seriously affect flight safety. Moreover, damp air is an important factor to corrode structural parts of the aircraft. Hence, improving mechanical properties of a key component in the aircraft, as well as hydrophobicity and ice resistance on the surface of a fuselage, is of great significance to the aerospace field.

Conventional machining methods for achieving a super-hydrophobic surface of a material include phase separation, flow coating/spray coating, microelectrical discharge machining, electroplating, sol-gel method, etc. However, these methods have their intrinsic limitations, such as toxic and harmful substances, environmental pollution, expensive raw materials, complicated process, poor stability and poor durability. This greatly restricts development and application of the existing super-hydrophobic surface preparation process in actual production. Laser machining, also known as a universal manufacturing technique, is gradually becoming a replacement of the conventional super-hydrophobic surface preparation process for its high production efficiency, reliable quality, high economic benefit, large processing flexibility, less pollution to human bodies and environments, and so on.

As a novel surface deformation enhancement technique, lase peening inhibits the initiation and propagation of fatigue cracks by changing surface microstructures of the material and inducing high-amplitude compressive residual stresses. The technique has the prominent advantages of good parameter controllability, and high enhancement efficiency, and is considered as a most effective method to prolong the fatigue life of the aeronautical aluminum alloy. Typically, it takes water or glass as a confining layer, and a black adhesive tape or an aluminum foil as an absorbing layer to enhance the substrate material. The technique for preparing the super-hydrophobic surface with the laser peening is implemented by removing the absorbing layer and directly irradiating a surface of the substrate with laser. By virtue of a thermo-mechanical coupling effect produced in blasting of laser plasma, hydrophobic porous micro-nano structures are formed on the surface of the substrate.

The fuselage of the aircraft rarely uses a flat sheet and shows a certain radian in most cases, which makes preparation of the super-hydrophobic surface on the arc-shaped aeronautical aluminum alloy highly difficult. Moreover, the fuselage is stressed complicatedly, and the preparation of the hydrophobic surface cannot affect comprehensive mechanical properties of the sheet. Therefore, the existing super-hydrophobic surface preparation process is hardly developed on arc-shaped materials.

SUMMARY

In view of shortages of the prior art, the present disclosure provides a pulse current-assisted laser peen forming and hydrophobic surface preparing method for an aluminum alloy. A high-frequency pulse current is introduced to assist the conventional laser peen forming process, such that a laser energy is allowed to directly act on the surface of an aluminum alloy material. GPa-magnitude plasma shock waves generated by laser irradiation are propagated to the aluminum alloy material under an action of a confining layer. Consequently, the near-surface texture of the aluminum alloy material is effectively enhanced, and a high-amplitude compressive residual stress layer is formed, thereby effectively improving fatigue performance of the aluminum alloy material. By introducing the high-frequency pulse current, both a thermal effect and a non-thermal effect can be generated in the aluminum alloy material. With the thermal effect, chemical driving forces for precipitation of the material in laser shock are increased, and more precipitates are generated in the material, thereby further enhancing mechanical properties of the substrate material. With the non-thermal effect, the flowing stress of the material can be reduced, the dislocation migration is effectively promoted and the material has a higher flowability. As a result, the recrystallization in plastic deformation is accelerated, and the formability when a large-sized thick sheet is shocked by the laser can be effectively improved. Under influences of the pulse current and the thermo-mechanical coupling effect of the laser peening, porous micro-nano multi-stage structures are formed on the surface of the aluminum alloy material. After the surface energy is reduced, the surface of the material can be super-hydrophobic. Therefore, with assistance of the pulse current, by taking the surface of the aluminum alloy material as the absorbing layer and high-temperature silicone oil as the confining layer, and setting effective paths and parameters in the laser shock, the present disclosure can control a shape and a property of the substrate material and the surface morphology of the aeronautical aluminum alloy synchronously, such that while the substrate of the aeronautical aluminum alloy sheet is effectively enhanced and macroscopically formed, the hydrophobicity on the surface of the material is achieved.

The present disclosure achieves the above technical objective through the following technical solutions.

A pulse current-assisted laser peen forming and hydrophobic surface preparing method for an aluminum alloy includes the following steps:

pretreating a surface of an aeronautical aluminum alloy;

placing a pretreated aluminum alloy onto a shock platform, where electrodes are respectively provided at two ends of the aluminum alloy, so as to locate a surface of the aluminum alloy and apply a high-frequency pulse current to the surface of the aluminum alloy, the surface of the aluminum alloy material serves as an absorbing layer, and flowing silicone oil covering the surface of the aluminum alloy serves as a confining layer;

determining a laser energy E according to material attributes of the aluminum alloy, and an acoustic impedance of each of the absorbing layer and the confining layer;

applying the high-frequency pulse current to the surface of the aluminum alloy through the electrodes, so as to perform electrical pulse treatment on the aluminum alloy, where a shot peening laser generates a laser beam according to the laser energy E to shock the surface of the aluminum alloy; and under an action of an electrical pulse and laser shock, the aluminum alloy shows a bent arc-shaped surface, with a shock surface forming a porous micro-nano multi-stage surface; and performing chemical modification on the shock surface of the aluminum alloy to reduce a surface energy of the material, thereby obtaining a super-hydrophobic arc-shaped aluminum alloy surface.

Further, the determining the laser energy E according to the material attributes of the aluminum alloy, and the acoustic impedance of each of the absorbing layer and the confining layer specifically includes:

obtaining a Hugoniot elastic limit $$HEL = \left(\frac{K}{2G} + \frac{2}{3}\right)\sigma_{0.2}$$

of the aluminum alloy according to a yield strength, a shear modulus, and a bulk modulus of the aluminum alloy, where, $\sigma_{0.2}$ is the yield strength of the aluminum alloy, MPa;

G is the shear modulus of the aluminum alloy, $$GPa,\ G = \left(\frac{E}{2(1+V)}\right);$$

K is the bulk modulus of the aluminum alloy, GPa, $$K = \left(\frac{E}{3(1-V)}\right);$$

E is an elastic modulus of the aluminum alloy; and

V is a Poisson's ratio of the aluminum alloy;

determining an optimal shock wave peak pressure $P_{max}$ of laser peening, and determining a laser power density $I_0$ according to the optimal shock wave peak pressure $P_{max}$, where the laser peening induced shock wave peak pressure $P_{max}$ and the laser power density $I_0$ satisfy a following relationship:

$$P_{max} = 0.01\sqrt{\frac{\alpha}{2\alpha+3}}\sqrt{Z}\sqrt{I_0},$$

where, $\alpha$ is a thermal conductivity coefficient; and

Z is a reduced acoustic impedance, and is expressed by:

$$\frac{2}{Z} = \frac{1}{Z_1} + \frac{1}{Z_2},$$

$Z_1$ being the acoustic impedance of the absorbing layer, and $Z_2$ being the acoustic impedance of the confining layer; and determining the laser energy E according to the laser power density $I_0$ by:

$$E = \frac{I_0 \tau \pi d^2}{4\chi},$$

where, $\chi$ is an absorption coefficient of the absorbing layer, $\tau$ is a pulse width of the laser, and d is a spot diameter, cm.

Further, the high-frequency pulse current applied to the surface of the aluminum alloy through the electrodes has a pulse width of 1 μs to 999 ms, a pulse frequency of 1 Hz to 100 KHz, a current of 1 A to 30 KA, and a duty cycle of 1% to 99%.

Further, the surface of the aluminum alloy is covered by the silicone oil at 30° C. to 100° C. Further, the flowing hot silicone oil has an acoustic impedance of $Z_2=2.2\times10^5$ $g\cdot cm^{-2}\cdot s^{-1}$, and the surface of the aluminum alloy has an absorption coefficient $\chi$ of 0.65.

Further, the shot peening laser is a Nd:YAG solid laser, and has a wavelength of 1,064 nm, a laser pulse width of <20 ns, a pulse frequency of 1 Hz to 5 Hz, a laser energy of <12 J, and a circular flat-top spot with a diameter of <8 mm.

Further, the performing chemical modification on the shock surface of the aluminum alloy to reduce the surface energy of the material includes: soaking a laser-peened aluminum alloy for 40 min to 60 min in an anhydrous ethanol solution containing 1-2% of perfluorooctyltriethoxysilane, and performing heat preservation for 40 min to 60 min in a thermotank at 100° C. to 120° C., such that an organofluorine compound is fully polymerized with the aluminum alloy and hydrophobicity is achieved on a machined surface of a fluorinated aluminum alloy.

Further, under the action of the electrical pulse and the laser shock, a middle of the aluminum alloy is protruded toward a laser shocking direction to form a deformed part with an arc-shaped cross section, two ends of the cross section being positions for locating the surface of the aluminum alloy.

The present disclosure has the following beneficial effects:

1. According to the pulse current-assisted laser peen forming and hydrophobic surface preparing method for the aluminum alloy provided by the present disclosure, a pulse current is applied to a surface of an aluminum alloy to form an electric field in the aluminum alloy. Electrons in the aluminum alloy move under an action of the electric field to generate a thermal effect and a non-thermal effect. With the thermal effect, chemical driving forces for precipitation of the material in laser shock are increased, and more precipitates are generated in the aluminum alloy, thereby enhancing mechanical properties of the aluminum alloy material. With the non-thermal effect, the flowing stress of the aluminum alloy can be reduced, the dislocation migration is effectively promoted and the material has a higher flowability. As a result, the recrystallization in plastic deformation is accelerated, the laser is effectively prevented from directly irradiating the material surface to weaken the formability in the shock, better formability in the laser shock is achieved, and the aluminum alloy material is better enhanced in the laser shock.

2. According to the pulse current-assisted laser peen forming and hydrophobic surface preparing method for the aluminum alloy provided by the present disclosure, the laser is directly irradiated onto the surface of the aluminum alloy material to generate a large amount of plasma. Under an action of the confining layer of the hot silicone oil, a GPa-magnitude shock wave pressure is generated. With assistance of the pulse current, the aluminum alloy sheet is formed macroscopically. Meanwhile, under influences of the pulse current and the thermo-mechanical coupling effect of the laser penning, hydrophobic porous micro-nano multi-stage structures can be effectively prepared on the surface of the aluminum alloy material. Hence, while the macroscopic deformation of the aluminum alloy sheet is realized, the super-hydrophobic surface is prepared. Particularly, upon deformation, the arc-shaped aluminum alloy surface has a desirable hydrophobic effect. The present disclosure effectively solves the problem of hard preparation for a hydrophobic surface at an arc-shaped key position of the aircraft, and can enhance comprehensive mechanical properties of the aeronautical aluminum alloy sheet after formation and hydrophobic surface preparation.

3. According to the pulse current-assisted laser peen forming and hydrophobic surface preparing method for the aluminum alloy provided by the present disclosure, all process parameters including current parameters and laser parameters can be controlled with algorithms. The present disclosure has the advantages of simple operation, low cost and high efficiency, is convenient for industrial applications, and achieves a wide application prospect in service environments of the aeronautical aluminum alloy.

BRIEF DESCRIPTION OF THE DRAWINGS

To describe the technical solutions in examples of the present disclosure or in the prior art more clearly, the accompanying drawings required for describing the examples or the prior art will be briefly described below. Apparently, the accompanying drawings in the following description show some examples of the present disclosure, and a person of ordinary skill in the art may still derive other drawings from these accompanying drawings without creative efforts.

In the figures.

Figure 1:
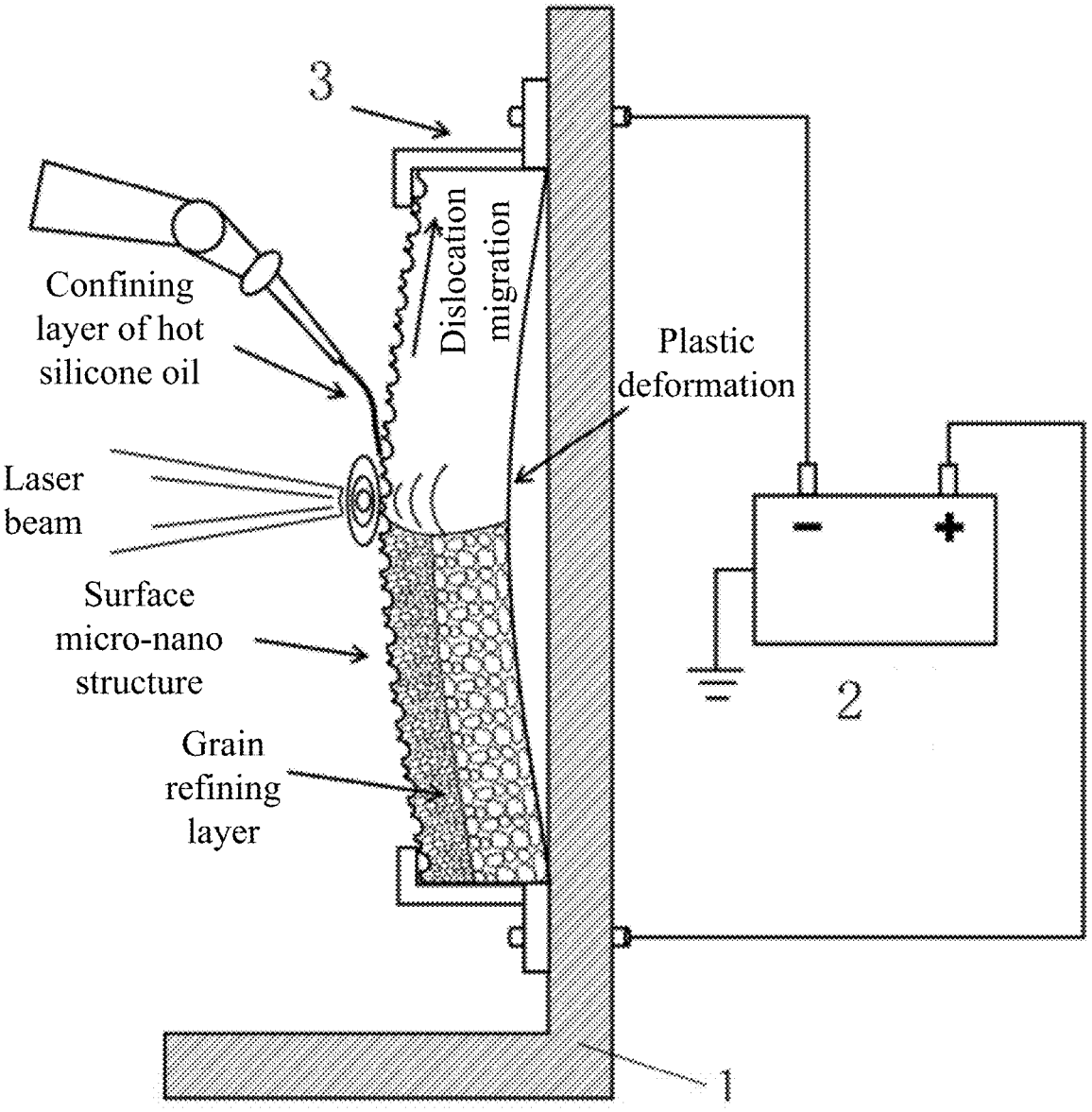
FIG. 1 is a schematic diagram of pulse current-assisted laser peen forming for an aeronautical aluminum alloy according to the present disclosure.

1—shock platform, 2—pulse current generator, and 3—electrode.

DETAILED DESCRIPTION OF THE EMBODIMENTS

The present disclosure will be further described below in conjunction with the accompanying drawings and specific examples, but the protection scope of the present disclosure is not limited thereto.

The embodiments of the present disclosure are described below in detail. Examples of the embodiments are shown in the drawings. The same or similar numerals represent the same or similar elements or elements having the same or similar functions throughout the specification. The embodiments described below with reference to the drawings are illustrative, which are merely intended to explain the present disclosure, rather than to limit the present disclosure.

It should be understood that, in the description of the present disclosure, the terms such as "central", "longitudinal", "transverse", "length", "width", "thickness", "upper", "lower", "axial", "radial", "vertical", "horizontal", "inner", and "outer" are intended to indicate orientations or positional relations shown in the drawings. It should be noted that these terms are merely intended to facilitate a simple description of the present disclosure, rather than to indicate or imply that the mentioned apparatus or elements must have the specific orientation or be constructed and operated in the specific orientation. Therefore, these terms may not be construed as a limitation to the present disclosure. Moreover, the terms such as "first" and "second" are used only for the purpose of description and should not be construed as indicating or implying a relative importance, or implicitly indicating a quantity of indicated technical features. Thus, features defined with "first" and "second" may explicitly or implicitly include one or more of the features. In the description of the present disclosure, "a plurality of" means two or more, unless otherwise specifically defined.

In the present disclosure, unless otherwise clearly specified and limited, the terms "installed", "connected with", "connected to", and "fixed" should be understood in a board sense. For example, the connection may be a fixed connection, a detachable connection or an integrated connection, may be a mechanical connection or an electrical connection, may be a direct connection or an indirect connection with use of an intermediate medium, or may be intercommunication between two components. Those of ordinary skill in the art may understand specific meanings of the above terms in the present disclosure based on a specific situation.

As shown in FIG. 1, the present disclosure provides a pulse current-assisted laser peen forming and hydrophobic surface preparing method for an aluminum alloy, including the following steps:

A surface of an aeronautical aluminum alloy is pretreated.

A pretreated aluminum alloy is placed onto a shock platform 1. Electrodes 3 are respectively provided at two ends of the aluminum alloy, so as to locate a surface of the aluminum alloy and apply a high-frequency pulse current to the surface of the aluminum alloy. The surface of the aluminum alloy material serves as an absorbing layer, and flowing silicone oil covering the surface of the aluminum alloy serves as a confining layer.

A laser energy E is determined according to material attributes of the aluminum alloy, and an acoustic impedance of each of the absorbing layer and the confining layer, specifically:

A Hugoniot elastic limit $$HEL = \left(\frac{K}{2G} + \frac{2}{3}\right)\sigma_{0.2}$$

of the aluminum alloy is obtained according to a yield strength, a shear modulus, and a bulk modulus of the aluminum alloy, where, $\sigma_{0.2}$ is the yield strength of the aluminum alloy, MPa;

G is the shear modulus of the aluminum alloy, $$GPa,\ G = \left(\frac{E}{2(1+V)}\right);$$

K is the bulk modulus of the aluminum alloy, GPa, $$K = \left(\frac{E}{3(1-V)}\right);$$

E is an elastic modulus of the aluminum alloy; and

V is a Poisson's ratio of the aluminum alloy.

An optimal shock wave peak pressure $P_{max}$ of laser peening is determined, and a laser power density $I_0$ is determined according to the optimal shock wave peak pressure $P_{max}$, where the laser peening induced shock wave peak pressure $P_{max}$ and the laser power density $I_0$ satisfy a following relationship:

$$P_{max} = 0.01\sqrt{\frac{\alpha}{2\alpha+3}}\sqrt{Z}\sqrt{I_0}$$

where, $\alpha$ is a thermal conductivity coefficient; and

Z is a reduced acoustic impedance, and is expressed by:

$$\frac{2}{Z} = \frac{1}{Z_1} + \frac{1}{Z_2},$$

$Z_1$ being the acoustic impedance of the absorbing layer, and $Z_2$ being the acoustic impedance of the confining layer.

The laser energy E is determined according to the laser power density $I_0$ by:

$$E = \frac{I_0\tau\pi d^2}{4\chi}$$

where, $\chi$ is an absorption coefficient of the absorbing layer, $\tau$ is a pulse width of the laser, and d is a spot diameter, cm.

The high-frequency pulse current is applied to the surface of the aluminum alloy through the electrodes 3, so as to perform electrical pulse treatment on the aluminum alloy. A shot peening laser generates a laser beam according to the laser energy E to shock the surface of the aluminum alloy. Under an action of an electrical pulse and laser shock, the aluminum alloy shows a bent arc-shaped surface, with a shock surface forming a porous micro-nano multi-stage surface.

Chemical modification is performed on the shock surface of the aluminum alloy to reduce a surface energy of the material, thereby obtaining a super-hydrophobic arc-shaped aluminum alloy surface.

According to the pulse current-assisted laser peen forming and hydrophobic surface preparing method for the aluminum alloy provided by the present disclosure, by assisting laser peening with a high-frequency pulse current, an electric field can be formed in the material. Electrons in the material move under an action of the electric field to generate a thermal effect and a non-thermal effect in the substrate material. With the thermal effect, chemical driving forces for precipitation of the material in laser shock are increased, and more precipitates are generated in the material, thereby enhancing mechanical properties of the substrate material. With the non-thermal effect, the flowing stress of the material can be reduced, the dislocation migration is effectively promoted and the material has a higher flowability. As a result, the recrystallization in plastic deformation is accelerated, the weak formability due to no absorbing layer is effectively prevented, better formability in the laser shock is achieved, and the substrate material is better enhanced through the laser shock. With assistance of the pulse current, the laser is directly irradiated onto the surface of the aeronautical aluminum alloy material to generate a GPa-magnitude plasma shock wave pressure for enhancing and forming the aeronautical aluminum alloy sheet. Meanwhile, under influences of the pulse current and the thermo-mechanical coupling effect of the laser peening, hydrophobic porous micro-nano multi-stage structures are formed on the surface of the aeronautical aluminum alloy material. The present disclosure prepares the super-hydrophobic surface while macroscopically forming and enhancing the aeronautical aluminum alloy sheet, allows the arc-shaped aeronautical aluminum alloy surface to have a desirable hydrophobic effect, and effectively solves the problem of hard preparation for a hydrophobic surface at an arc-shaped key position of the aircraft.

In order to make the objectives, technical solutions and advantages of the present disclosure more apparent, by taking a 2024-T351 aeronautical aluminum alloy as a study object, the present disclosure will be described in detail below with reference to examples.

Example 1

In Example 1, the pulse current-assisted laser peen forming and hydrophobic surface preparing method for the aluminum alloy includes the following specific steps:

A surface of a 2024-T351 aeronautical aluminum alloy sheet was ground and polished by an automatic polish-grinding machine, until a mirror-like effect (Ra≤50 μm) was achieved. The surface of the sheet was then cleaned with an anhydrous ethanol solution, and dried for later use.

A pretreated aeronautical aluminum alloy sheet was placed onto a shock platform 1. Two ends of the aluminum alloy sheet were fixed by positive and negative electrodes 3 that had a clamping function and applied a high-frequency pulse current. The electrodes 3 were attached in the vicinity of a to-be-enhanced surface of a workpiece. The current could be applied to a position near an upper surface of the aluminum alloy sheet, thereby flowing through the aluminum alloy sheet. The electrodes 3 were connected to a pulse current generator 2. The pulse current generator 2 has a pulse width of 200 μs, a pulse frequency of 1,500 Hz, a current of 1,000 A, and a duty cycle of 50%.

The surface of the aluminum alloy material was taken as an absorbing layer. A hot silicone oil ejector device was turned on. A 2 mm thick hot silicone oil layer covered the surface of the aeronautical aluminum alloy sheet to serve as a confining layer. When powered on, the aluminum alloy generates heat. The silicone oil controlled at 30° C. to 100° C. has a less impact on the aluminum alloy. The silicone oil is non-conducting and thus is taken as the confining layer.

A laser energy E was determined according to material attributes of the aluminum alloy, and an acoustic impedance of each of the absorbing layer and the confining layer, specifically:

A Hugoniot elastic limit $$HEL = \left(\frac{K}{2G} + \frac{2}{3}\right)\sigma_{0.2}$$

of the aluminum alloy was obtained according to a yield strength, a shear modulus, and a bulk modulus of the aluminum alloy, where, $\sigma_{0.2}$ was the yield strength of the aluminum alloy, MPa;

G was the shear modulus of the aluminum alloy, GPa, $$G = \left(\frac{E}{2(1+V)}\right);$$

K was the bulk modulus of the aluminum alloy, GPa, $$K = \left(\frac{E}{3(1-V)}\right);$$

E was an elastic modulus of the aluminum alloy; and

V was a Poisson's ratio of the aluminum alloy.

Through calculation, $HEL_{2024\text{-}T351}$=640.5 MPa.

An optimal shock wave peak pressure of laser peening was $P_{max}$=1281-1601 MPa according to $P_{max}$=2-2.5 HEL.

A laser power density $I_0$ was determined according to the optimal shock wave peak pressure $P_{max}$, where the laser peening induced shock wave peak pressure $P_{max}$ and the laser power density Jo satisfied a following relationship:

$$P_{max} = 0.01\sqrt{\frac{\alpha}{2\alpha+3}}\sqrt{Z}\sqrt{I_0}$$

where, α was a thermal conductivity coefficient, and 0.1;

Z was a reduced acoustic impedance, and was expressed by:

$$\frac{2}{Z} = \frac{1}{Z_1} + \frac{1}{Z_2},$$

$Z_1$ being the acoustic impedance of the absorption layer, and $Z_2$ being the acoustic impedance of the constraint layer, and $Z=3.83\times10^5$ g·cm$^{-2}$·s$^{-1}$.

Through calculation, the laser power density $I_0$=1.37-2.14 GW/cm$^2$.

The laser energy E was determined according to the laser power density $I_0$ by:

$$E = \frac{I_0\tau\pi d^2}{4\chi}$$

where, χ was an absorption coefficient of the absorbing layer, and 0.65; τ was a pulse width of the laser, and 15 ns; and d was a spot diameter, and 0.3 cm. It was determined that the most suitable laser energy was E=2.5-3.5 J. The laser peening in Example 1 has a pulse width of 15 ns, a laser energy of 2.5 J, a spot diameter of 3 mm, and an overlapping ratio of 50%, and is performed once.

Simulation: Relevant parameters of pulse current-assisted laser peening and a peening path were set in Abaqus software, so as to explore stress distributions and amplitudes of the material, and observe deformations of the materials, thereby accurately controlling deformations of the aeronautical aluminum alloy sheet.

The pulse current generator 2 was turned on. A current could be applied at the position close to the upper surface of the aluminum alloy sheet, thereby flowing through the aluminum alloy sheet. An Nd:YAG nanosecond pulse laser was turned on to perform the laser peening on the aeronautical aluminum alloy sheet under corresponding parameters. Under an action of an electrical pulse and laser shock, the aluminum alloy showed a curved arc-shaped surface, with a shock surface forming a porous micro-nano multi-stage surface.

The confining layer of the hot silicone oil on the surface of the aeronautical aluminum alloy was cleaned. A shot-peened aluminum alloy was soaked for 40 min in an anhydrous ethanol solution containing 1.5% of perfluorooctyltriethoxysilane. Heat preservation was performed for 40 min in a thermotank at 100° C., such that an organofluorine compound was fully polymerized with the aluminum alloy and desirable hydrophobicity was achieved on a shot-peened surface of a fluorinated aluminum alloy, thereby obtaining a super-hydrophobic arc-shaped aluminum alloy surface.

Figure 2:
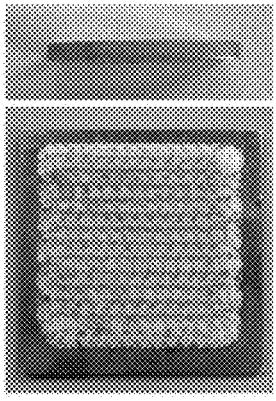
FIG. 2 illustrates a forming effect and an actual effect of a shot-peened surface according to Example 1 of the present disclosure.
Figure 5:
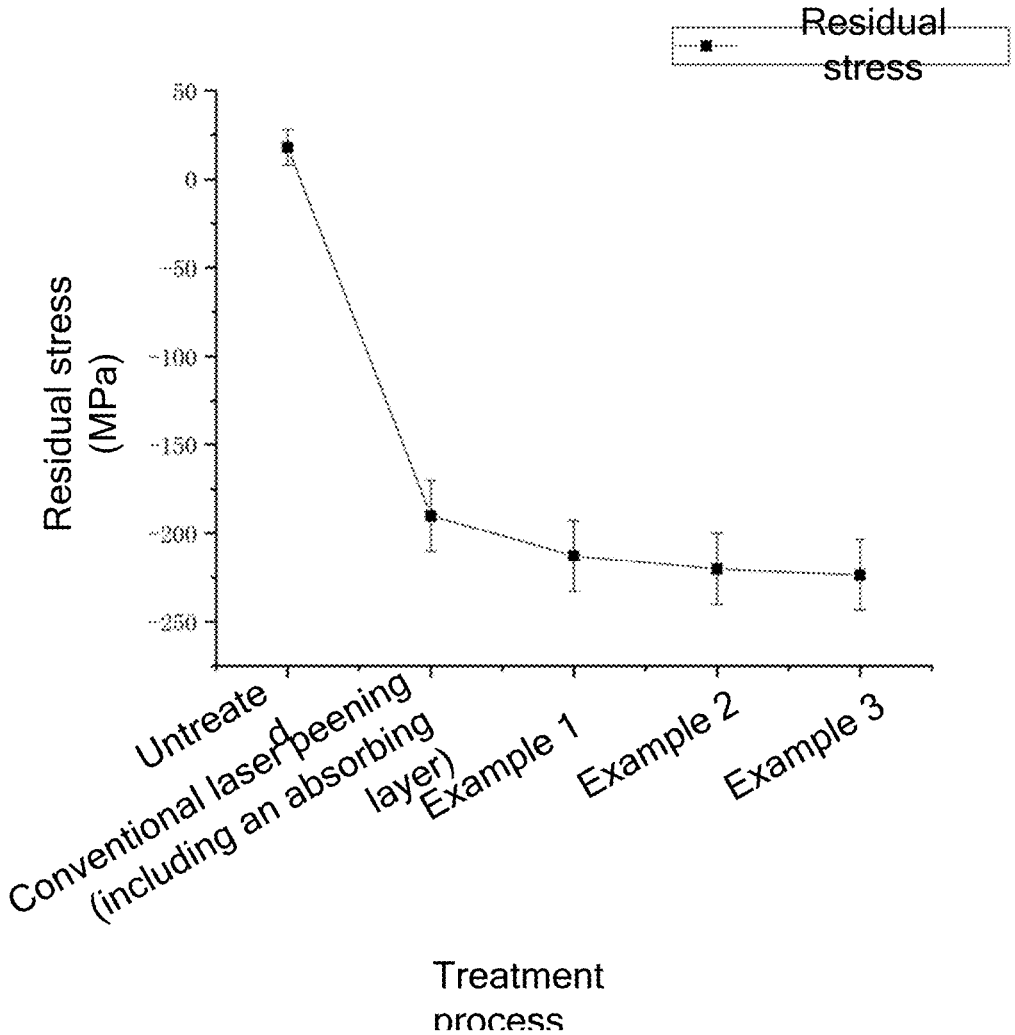
FIG. 5 illustrates a comparison between the present disclosure and the prior art in a residual stress along a depth direction.
Figure 6:
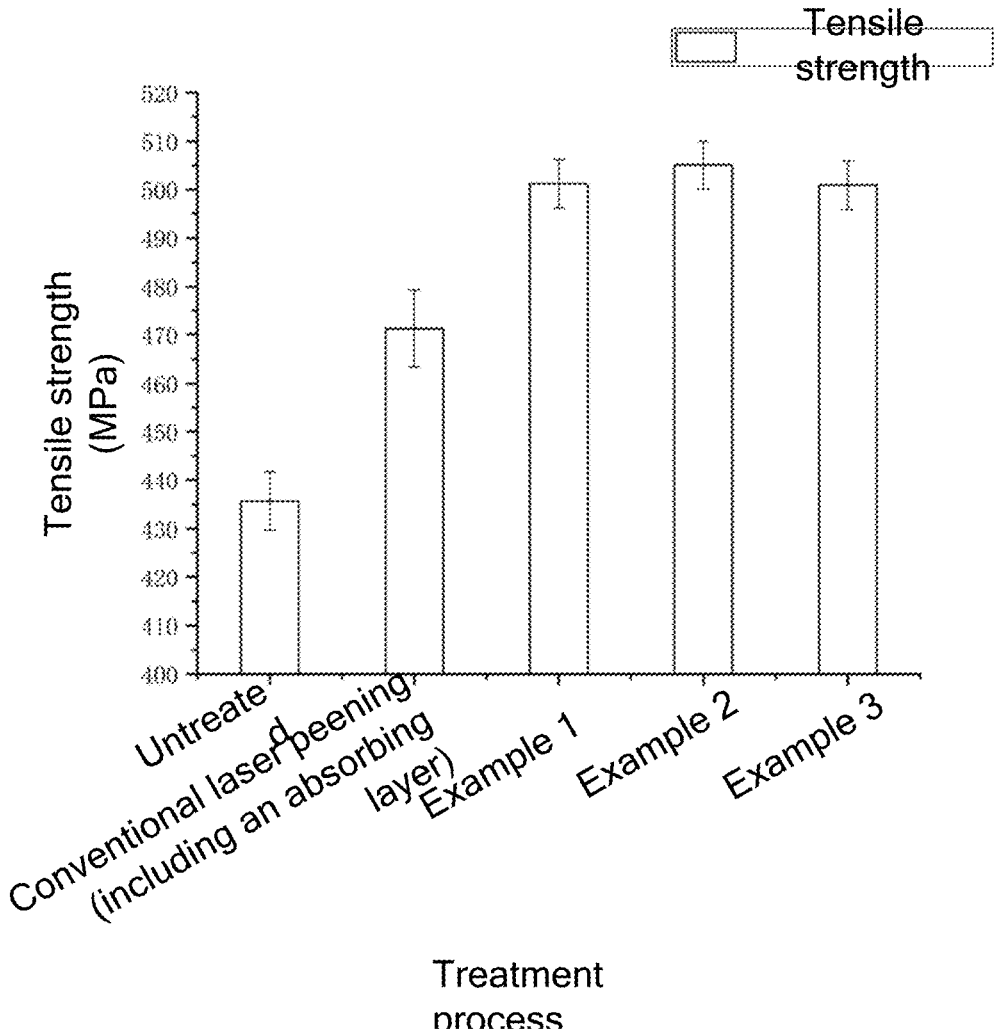
FIG. 6 illustrates a comparison between the present disclosure and the prior art in a tensile strength of a sample.
Figure 7:
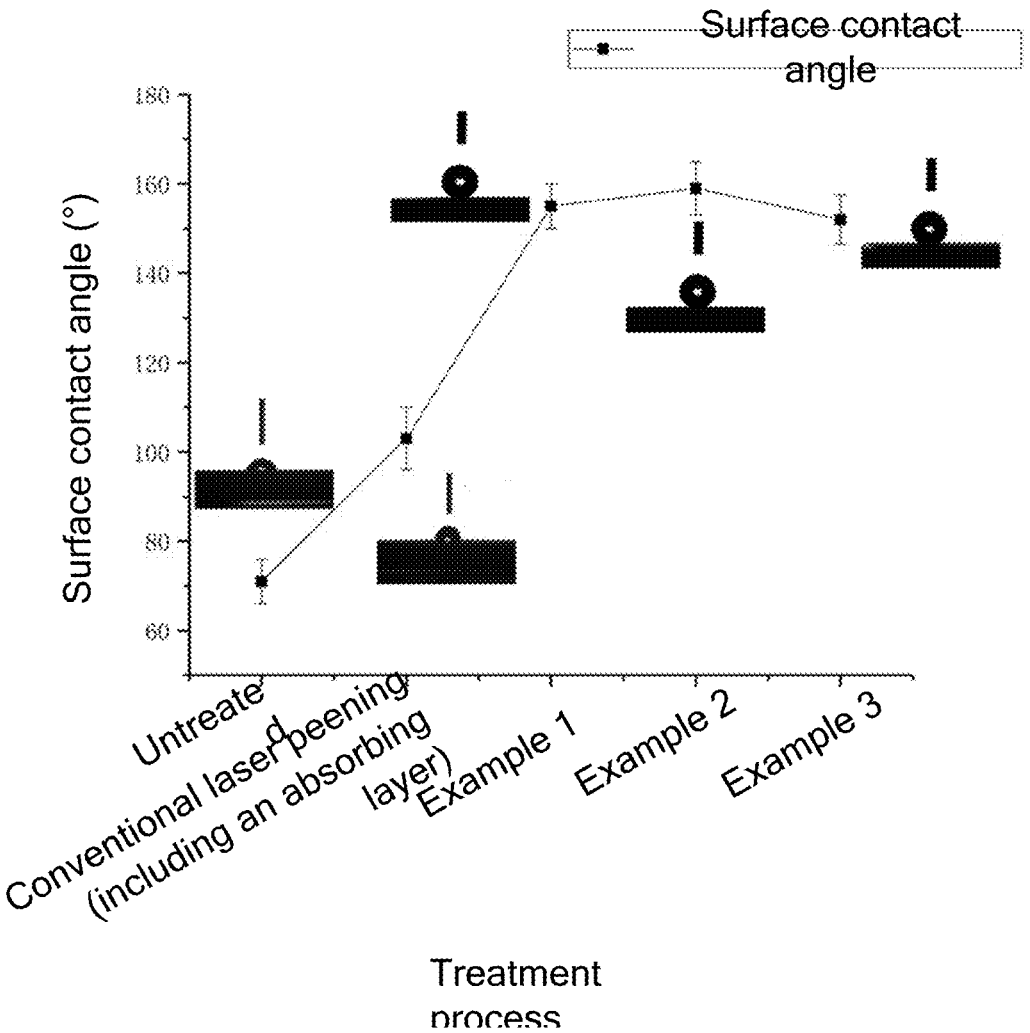
FIG. 7 illustrates contact angles of droplets on a surface of a sample in the present disclosure and the prior art.
Figure 8:
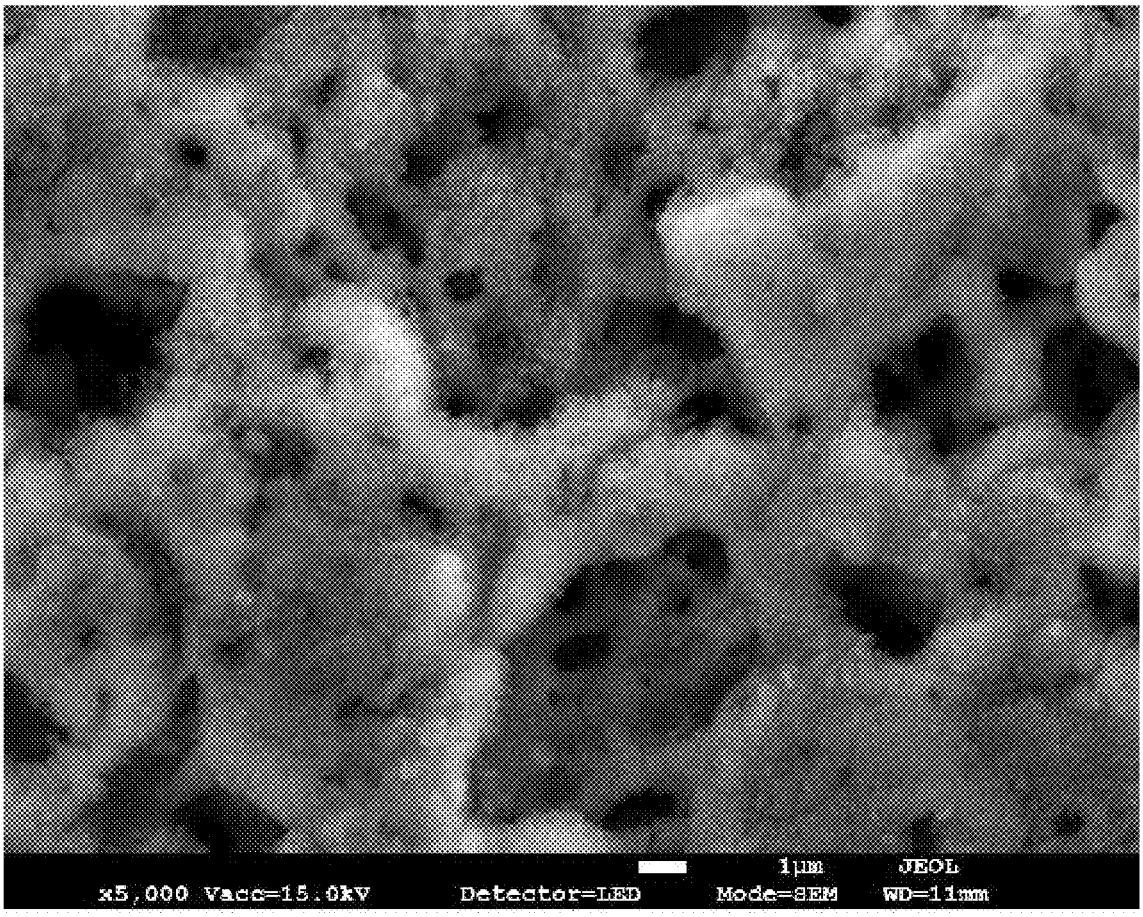
FIG. 8 is a scanning electron microscope (SEM) diagram of porous micro-nano multi-stage structures on a surface of a sample in Example 1 of the present disclosure.

A forming effect and a shot-peened surface of an aeronautical aluminum alloy sample prepared in Example 1 are shown in FIG. 2. With assistance of the pulse current, plasma shock waves having a GPa-magnitude pressure are generated by the laser peening. Consequently, a large number of dislocations are squeezed, such that a substrate of the sample is bent. On a surface of the sample, a large number of porous micro-nano multi-stage structures are prepared due to the pulse current and the thermo-mechanical effect of the laser peening. FIG. 8 is an SEM diagram of the porous micro-nano multi-stage structures on the surface in Example 1. The porous micro-nano multi-stage structures can be effective in reducing contact areas between droplets and the surface of the material, thereby making the droplets less adhesive on the surface of the aeronautical aluminum alloy. Due to an electro-plastic effect, a thermal effect and a non-thermal effect of the pulse current in the aeronautical aluminum alloy material, the substrate material is better enhanced through the laser peening on the aeronautical aluminum alloy. As shown in FIG. 5 and Table 1, the average residual stress of the aeronautical aluminum alloy sample in Example 1 at 100 μm above the surface is −212.7 MPa, an increase of 11.9% compared to −190.1 MPa of the conventional laser peening. As shown in FIG. 6 and Table 1, the tensile strength of the aeronautical aluminum alloy sample in Example 1 is 501.2 MPa, an increase of 6.4% compared to 471.3 MPa of the conventional laser peening. As shown in FIG. 7 and Table 1, there are the porous micro-nano multi-stage structures on the surface of the aeronautical aluminum alloy sample in Example 1. After the surface energy of the material is reduced, the droplets (4 μL) on the surface of the sample have an average contact angle of 155°, and an average sliding angle of 8.3°, which reaches the super-hydrophobic level. However, the conventional laser peening lacks the micro-nano multi-stage structures for forming the super-hydrophobic surface, so the droplets on the surface only have a contact angle of 103°, and cannot slide. Therefore, the present disclosure synchronously realizes substrate enhancement, macroscopic formation and hydrophobic surface preparation of the aeronautical aluminum alloy sheet.

Example 2

On the basis of Example 1, the pulse current generator 2 in Example 2 has a pulse width of 200 μs, a pulse frequency of 1,800 Hz, a current of 2,000 A, and a duty cycle of 50%.

The laser peening in Example 2 has a pulse width of 15 ns, a laser energy of 3 J, a spot diameter of 3 mm, and an overlapping ratio of 50%, and is performed once. 2 mm flowing hot silicone oil serves as the confining layer.

Figure 3:
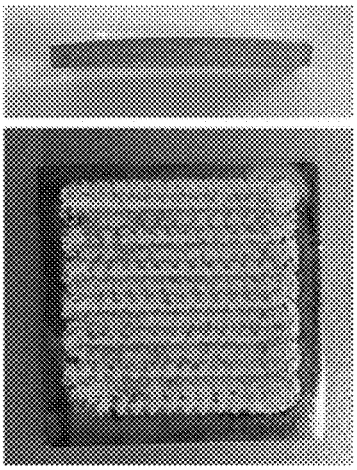
FIG. 3 illustrates a forming effect and an actual effect of a shot-peened surface according to Example 2 of the present disclosure.

A forming effect and a shot-peened surface of an aeronautical aluminum alloy sample prepared in Example 2 are shown in FIG. 3. Compared with Example 1, the aeronautical aluminum alloy sheet in Example 2 shows a larger macroscopic deformation, because a larger pulse current with a higher frequency is introduced, and a larger laser energy is generated in an elasticity threshold of the metal. The porous micro-nano multi-stage structures on the surface of the aeronautical aluminum alloy are similar to those in Example 1. As shown in FIG. 5 and Table 1, the average residual stress of the aeronautical aluminum alloy sample in Example 2 at 100 μm above the surface is −220.1 MPa, an increase of 15.8% compared to the conventional laser peening. As shown in FIG. 6 and Table 1, the tensile strength in Example 2 is 505.1 MPa, an increase of 7.2% compared to 471.3 MPa of the conventional laser peening. As shown in FIG. 7 and Table 1, after chemical modification is performed on the surface of the sample in Example 2, the droplets have an average contact angle of 159°, and an average sliding angle of 7.0°, which reaches the super-hydrophobic level. Therefore, the present disclosure synchronously realizes substrate enhancement, macroscopic formation and hydrophobic surface preparation of the aeronautical aluminum alloy sheet.

Example 3

On the basis of Example 1, the pulse current generator 2 in Example 3 has a pulse width of 200 μs, a pulse frequency of 1,000 Hz, a current of 2,000 A, and a duty cycle of 50%.

The laser peening in Example 3 has a pulse width of 15 ns, a laser energy of 3.5 J, a spot diameter of 3 mm, and an overlapping ratio of 50%, and is performed once. 2 mm flowing hot silicone oil serves as the confining layer.

Figure 4:
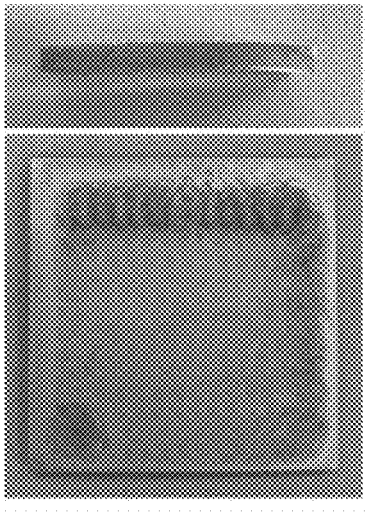
FIG. 4 illustrates a forming effect and an actual effect of a shot-peened surface according to Example 3 of the present disclosure.

A forming effect and a shot-peened surface of an aeronautical aluminum alloy sample prepared in Example 3 are shown in FIG. 4. Same as Example 1 and Example 2, with assistance of the pulse current and under the GPa-magnitude shock wave pressure in the laser peening, the substrate of the aeronautical aluminum alloy sheet shows a certain arc-shaped macroscopic deformation. On the surface of the substrate, there are also the porous micro-nano multi-stage structures. As shown in FIG. 5 and Table 1, the average residual stress of the aeronautical aluminum alloy sample in Example 3 at 100 μm above the surface is −223.4 MPa, an increase of 17.5% compared to −190.1 MPa of the conventional laser peening. As shown in FIG. 6 and Table 1, the tensile strength of the aeronautical aluminum alloy sample in Example 3 is 500.9 MPa, an increase of 6.3% compared to the conventional laser peening. As shown in FIG. 7 and Table 1, after chemical modification is performed on the surface of the sample in Example 3, the droplets on the surface have an average contact angle of 152°, and an average sliding angle of 9.6°, which realizes the preparation of the super-hydrophobic surface. Therefore, the present disclosure synchronously realizes substrate enhancement, macroscopic formation and hydrophobic surface preparation of the aeronautical aluminum alloy sheet.

Table 1 Various properties of samples in different treatment processes

TABLE 1

Various properties of samples in different treatment processes

| Treatment | | Various properties | | | |
|---|---|---|---|---|---|
| | | Compressive residual stress/ MPa | Tensile strength/ MPa | Surface contact angle/° | Sliding angle/° |
| No treatment | | +18 | 435.7 | 71 | / |
| Conventional laser peening (including an absorbing layer) | | −190.1 | 471.3 | 103 | / |
| Pulse current-assisted laser peen forming | Example 1 | −212.7 | 501.2 | 155 | 8.3 |
| | Example 2 | −220.1 | 505.1 | 159 | 7.0 |
| | Example 3 | −223.4 | 500.9 | 152 | 9.6 |

It should be understood that although this specification is described in accordance with the examples, not every example only includes one independent technical solution. This description of the specification is for the sake of clarity only. Those skilled in the art should take the specification as a whole, and the technical solutions in examples can also be appropriately combined to form other implementations that can be understood by those skilled in the art.

The series of detailed description listed above are only specific illustration of feasible examples of the present disclosure, rather than limiting the claimed scope of the present disclosure. All equivalent examples or changes made without departing from the technical spirit of the present disclosure should be included in the claimed scope of the present disclosure.

What is claimed is:

1. A pulse current-assisted laser peen forming and hydrophobic surface preparing method for an aluminum alloy, comprising the following steps:

pretreating a surface of an aeronautical aluminum alloy;

placing a pretreated aluminum alloy onto a shock platform, wherein electrodes are respectively provided at two ends of the aluminum alloy, to locate a surface of the aluminum alloy and apply a high-frequency pulse current to the surface of the aluminum alloy; the surface of the aluminum alloy material serves as an absorbing layer, and flowing silicone oil covering the surface of the aluminum alloy serves as a confining layer, wherein the surface of the aluminum alloy is covered by the silicone oil at 30° C. to 100° C.;

determining a laser energy E according to material attributes of the aluminum alloy, and an acoustic impedance of each of the absorbing layer and the confining layer;

applying the high-frequency pulse current to the surface of the aluminum alloy through the electrodes to perform electrical pulse treatment on the aluminum alloy, wherein a shot peening laser generates a laser beam according to the laser energy E to shock the surface of the aluminum alloy; under an action of an electrical pulse and laser shock, the aluminum alloy shows a bent arc-shaped surface, with a shock surface forming a porous micro multi-stage surface; and under the action of the electrical pulse and the laser shock, a middle of the aluminum alloy is protruded toward a laser shocking direction to form a deformed part with an arc-shaped cross section, two ends of the cross section being positions for locating the surface of the aluminum alloy; and performing chemical modification on the shock surface of the aluminum alloy to reduce a surface energy of the material, thereby obtaining a super-hydrophobic arc-shaped aluminum alloy surface.

2. The pulse current-assisted laser peen forming and hydrophobic surface preparing method for the aluminum alloy according to claim 1, wherein the determining the laser energy E according to the material attributes of the aluminum alloy, and the acoustic impedance of each of the absorbing layer and the confining layer comprises:

obtaining a Hugoniot elastic limit $$HEL = \left(\frac{K}{2G} + \frac{2}{3}\right)\sigma_{0.2}$$

of the aluminum alloy according to a yield strength, a shear modulus, and a bulk modulus of the aluminum alloy, wherein, $\sigma_{0.2}$ is the yield strength of the aluminum alloy, MPa;

G is the shear modulus of the aluminum alloy, GPa, $$G = \left(\frac{E}{2(1+V)}\right);$$

K is the bulk modulus of the aluminum alloy, GPa, $$K = \left(\frac{E}{3(1-V)}\right);$$

E is an elastic modulus of the aluminum alloy; and

V is a Poisson's ratio of the aluminum alloy;

determining an optimal shock wave peak pressure $P_{max}$ of laser peening, and determining a laser power density $I_0$ according to the optimal shock wave peak pressure $P_{max}$, wherein the laser peening induced shock wave peak pressure $P_{max}$ and the laser power density $I_0$ satisfy a following relationship:

$$P_{max} = 0.01\sqrt{\frac{\alpha}{2\alpha+3}}\sqrt{Z}\sqrt{I_0},$$

wherein, $\alpha$ is a thermal conductivity coefficient; and

Z is a reduced acoustic impedance, and is expressed by:

$$\frac{2}{Z} = \frac{1}{Z_1} + \frac{1}{Z_2},$$

$Z_1$ being the acoustic impedance of the absorbing layer, and $Z_2$ being the acoustic impedance of the confining layer; and determining the laser energy E according to the laser power density $I_0$ by:

$$E = \frac{I_0 \tau \pi d^2}{4\chi}$$

wherein, $\chi$ is an absorption coefficient of the absorbing layer, $\tau$ is a pulse width of the laser, and d is a spot diameter, cm.

3. The pulse current-assisted laser peen forming and hydrophobic surface preparing method for the aluminum alloy according to claim 1, wherein the high-frequency pulse current applied to the surface of the aluminum alloy through the electrodes has a pulse width of 200 μs, a pulse frequency of 1000 Hz to 1800 Hz, a current of 1 kA to 2 kA, and a duty cycle of 50%.

4. The pulse current-assisted laser peen forming and hydrophobic surface preparing method for the aluminum alloy according to claim 1, wherein the flowing hot silicone oil has an acoustic impedance of $Z_2=2.2\times10^5$ $g\cdot cm^{-2}\cdot s^{-1}$, and the surface of the aluminum alloy has an absorption coefficient $\chi$ of 0.65.

5. The pulse current-assisted laser peen forming and hydrophobic surface preparing method for the aluminum alloy according to claim 1, wherein the shot peening laser is a Nd:YAG solid laser, and has a wavelength of 1,064 nm, a laser pulse width of <20 ns, a pulse frequency of 1 Hz to 5 Hz, a laser energy of <12 J, and a circular flat-top spot with a diameter of <8 mm.

6. The pulse current-assisted laser peen forming and hydrophobic surface preparing method for the aluminum alloy according to claim 1, wherein the performing chemical modification on the shock surface of the aluminum alloy to reduce the surface energy of the material comprises: soaking a laser-peened aluminum alloy for 40 min to 60 min in an anhydrous ethanol solution containing 1-2% of perfluorooctyltriethoxysilane, and performing heat preservation for 40 min to 60 min in a thermotank at 100° C. to 120° C., such that an organofluorine compound is fully polymerized with the aluminum alloy and hydrophobicity is achieved on a machined surface of a fluorinated aluminum alloy.

* * * * *